United States Patent [19]

Haines et al.

[11] Patent Number: 4,488,093

[45] Date of Patent: Dec. 11, 1984

[54] COLOR SHADOW MASK CATHODE RAY TUBES

[75] Inventors: Doug Haines, Mulino; Keith Taylor; Murlan Kaufman, both of Portland, all of Oreg.

[73] Assignee: Tektronix, Inc., Beaverton, Oreg.

[21] Appl. No.: 456,932

[22] PCT Filed: Mar. 30, 1982

[86] PCT No.: PCT/US82/00406

§ 371 Date: Oct. 1, 1982

§ 102(e) Date: Oct. 1, 1982

[87] PCT Pub. No.: WO82/03494

PCT Pub. Date: Oct. 14, 1982

[30] Foreign Application Priority Data

Mar. 31, 1981 [JP] Japan ..... 56-48312

[51] Int. Cl.[3] ..... H01J 29/80

[52] U.S. Cl. ..... 315/375

[58] Field of Search ..... 315/375, 368; 313/463, 313/467, 472

[56] References Cited

U.S. PATENT DOCUMENTS 3,928,785 12/1975 Standaart ..... 313/470

4,385,259 5/1983 Chase et al. ..... 315/368

*Primary Examiner*—Theodore M. Blum

*Attorney, Agent, or Firm*—John Smith-Hill

[57] ABSTRACT

A color shadow mask cathode ray tube has arrays of three phosphors deposited on the back of its faceplate. The color radiated by one of the phosphors corresponds to that which is produced when the colors radiated by the other two phosphors are combined.

5 Claims, 7 Drawing Figures

COLOR SHADOW MASK CATHODE RAY TUBES

TECHNICAL FIELD

This invention relates to color shadow mask cathode ray tubes.

BACKGROUND ART

When several kinds of information are to be displayed on a cathode ray tube (CRT), a color display helps the operator categorize the information more easily than does a monochrome display. The conventional color shadow mask CRT includes red (R), green (G), and blue (B) phosphors on the back of the faceplate of the CRT. When one or more of these phosphors are irradiated by the electron guns of the CRT, many different colors can be rendered visible on the CRT. However, when using two or more beams to irradiate two or more color phosphors and thereby provide a combined color, the beams are sometimes misconverged. This misconvergence causes a reduction in the quality of the resolution of the display. in order to overcome this problem, these color CRTs are provided with convergence circuits for compensating for this misconvergence. The convergence circuits can be very complex and expensive. Consequently, the conventional color CRTs are not suitable for use with simple color displays, such as logic analyzer displays in which only a few different colors are required. Self-converged CRTs employing red, green and blue phosphors are known, but the amount of possible misconvergence of a display using more than one color is not tolerable.

DISCLOSURE OF INVENTION

According to one aspect of the present invention there is provided a color shadow mask cathode ray tube having a faceplate upon the back of which are deposited arrays of first, second and third phosphors which radiate first, second and third colors respectively when irradiated by electrons, and first, second and third electron guns for providing beams of electrons for irradiating the first, second and third phosphors respectively, the first, second and third colors being such that said third color is produced when said first and second colors are combined.

According to another aspect of the present invention there is provided a method of providing a color display, comprising employing a shadow mask color CRT having a face plate upon the back of which are deposited arrays of first, second and third phosphors which radiate first, second and third colors respectively when irradiated by electrons, said third color also being produced when said first and second colors are combined, and the method also comprising providing first, second and third electron beams for irradiating the first, second and third phosphors respectively, and controlling the first, second and third electron beams to cause the third color to be produced by irradiating the first and second phosphors when the third color is to be displayed in an area adjacent to an area in which the first color is displayed, and to cause the third color to be produced by irradiating the third phosphor when the third color is to be displayed in an area which is separate from areas in which the first color is displayed.

The present invention makes it possible to provide a color logic analyzer display apparatus in which the quality of the characters on the display reflect near perfect convergence, and wherein the use of more than one electron beam at a time is minimized thereby eliminating the need for complex convergence circuits.

Preferably, the first, second and third colors are red, green and yellow respectively and, for the most part, only one color phosphor is irradiated at a time for generation of the display.

Red, green and yellow are high acuity colors, and are therefor inherently suitable for use in an information display. By use of yellow as the third color the advantage is obtained that an area of yellow can be provided within or adjacent a larger area of red by irradiating both the red and green phosphors within that area. There is no convergence problem because it is not necessary that the area of irradiated green phosphors be in registry with an area of irradiated red phosphors. When it is desired to provide an area of yellow which is separate from red and green areas, only the yellow phosphors are irradiated and again there is no convergence problem. The only situation in which a potential convergence problem arises is at the interface between a first yellow area provided by irradiating yellow phosphors and a second yellow area provided by irradiating green and red phosphors adjacent a red area, when misconvergence may cause misalignment of the two yellow areas. If, notwithstanding its relatively poor acuity, the third color were blue, misconvergence would cause loss of image quality whenever an area of blue was required within or adjacent an area of red or green.

BRIEF DESCRIPTION OF DRAWINGS

For better understanding of the invention, and to show how the same may be carried into effect, reference will now be made, by way of example, to the accompanying drawings in which.

BEST MODE OF CARRYING OUT THE INVENTION

Figure 1:
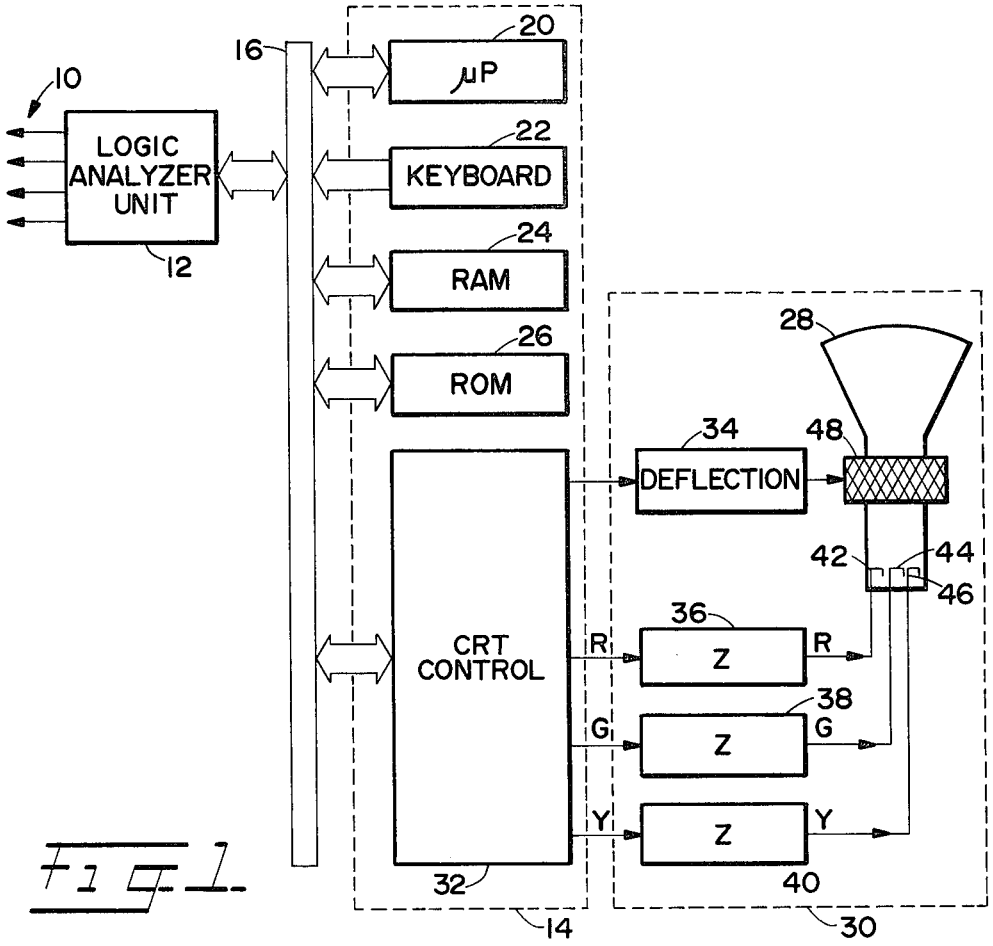
FIG. 1 is a block diagram of a logic analyzer display apparatus.

The logic analyzer display apparatus illustrated in FIG. 1 comprises a logic analyzer unit 12, a control unit 14 and a display unit 30. The logic analyzer unit 12 (shown in greater detail in FIG. 6) is provided with probe tips 10 for picking up logic signals from a product under test (not shown). The acquired logic signals are processed by the analyzer unit 12 and the control unit 14 so as to represent the acquired information in the form of 6-bit words each representing one of 64 predetermined display characters (alphanumeric characters and timing diagram elements), and the control unit 14 causes a raster scan CRT 28 of the display unit 30 to display the characters in a rectangular array of up to 24 lines each consisting of up to 80 characters. The display thus represents visually the relationship among the logic levels existing at various points of the product under test, and enables the operator to determine whether the produce under test is functioning correctly.

Each character is displayed within a rectangular field or background area, and the control unit 14 controls four video attributes, which characterize the manner in which the character is displayed. These attributes are the color of the character, the color of the field, whether the character is displayed in the reverse video mode (the character and field colors reversed) and whether the character is displayed in the blink mode (intermittent display).

Figure 6:
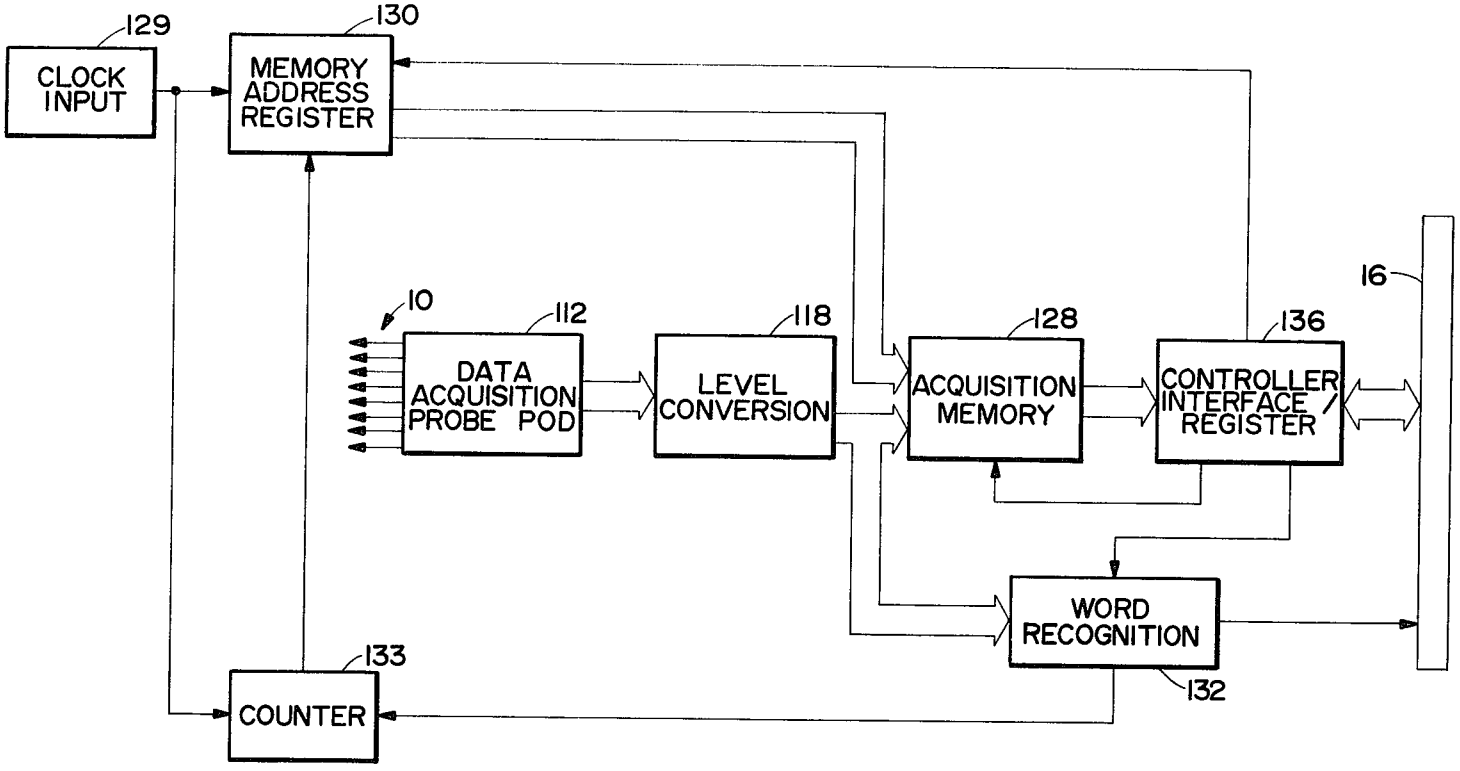
FIGS. 6 and 7 illustrate the structures of respective blocks shown in FIG. 1.

As shown in FIG. 6, the logic analyzer unit 12 comprises at least one data acquisition probe pod 112. Each probe pod has eight probe tips 10 connected thereto, which pick up the logic signals from the terminals of the product under test. The probe pods transfer the logic signals to a level conversion circuit 118 via a data bus. The conversion circuit 118 determines whether or not the logic signals being inputted thereto are logical ones or zeros and then converts these input logic levels into predetermined internal logic levels corresponding to the logical ones and zeros but at different potentials from the input logic levels. The level conversion circuit 118 is connected to an acquisition memory circuit 128. The memory circuit 128 is divided into certain sections which correspond to the individual probe pods. Also connected to the acquisition memory 128 is a memory address register 130 which addresses certain locations in the memory 128 and, in accordance with this addressing function, the level conversion circuit stores the internal logic levels into the addressed locations in the acquisition memory. The internal logic levels associated with probe pod 112 are stored in a section of the acquisition memory 128 which corresponds to that probe pod, and similarly the internal logic levels associated with other probe pods are stored in their corresponding sections of the acquisition memory, in response to the addressing function performed by the memory address register 130.

The level conversion circuit 118 is also connected to the input of a word recognition circuit 132. The word recognition circuit 132 detects whether or not a desired data word has been received from the level conversion circuit 118 and stored in the acquisition memory, and applies an output signal to the main bus 16 in response thereto. The word recognition circuit 132 also energizes a counter 133 in response to receipt of the desired word from the level conversion circuit 118. The counter is also energized by a clock input 129, the clock input causing the counter to count to a predetermined level. When the count is completed, the counter energizes the memory address register 130 thereby stopping the incrementation of the memory address register, and further, preventing the storage of the internal logic levels from the level conversion circuit 118 into the acquisition memory 128.

The controller interface/register circuit 136 is connected to the output of the acquisition memory 128 and, thereby, receives the stored data from the acquisition memory 128 in a readout mode. The interface/register circuit 136 supplies the stored data to the main bus 16. Moreover, the circuit 136 receives control signals from the main bus 16 to control the store/readout mode of the acquisition memory circuit 128 and the address counting speed of the memory address register 130, and to determine the desired word received by the word recognition circuit 132.

The control unit 14 is connected to the logic analyzer unit 12 by the main bus 16, including data, address and control buses. The control unit 14 comprises a microprocessor 20 which, under control of a keyboard 22, processes the data retrieved from the interface/register circuit 136 in accordance with firmware stored in a read-only memory (ROM) 26 and in response thereto generates the 6-bit words representative of the characters to be displayed. The signals from the microprocessor 20 are stored in a random access memory (RAM) 24. By way of the keyboard 22, the operator can select the nature of the display, i.e., whether a timing diagram is to be displayed or information is to be displayed in the form of a table of alphanumeric characters.

Figure 7:
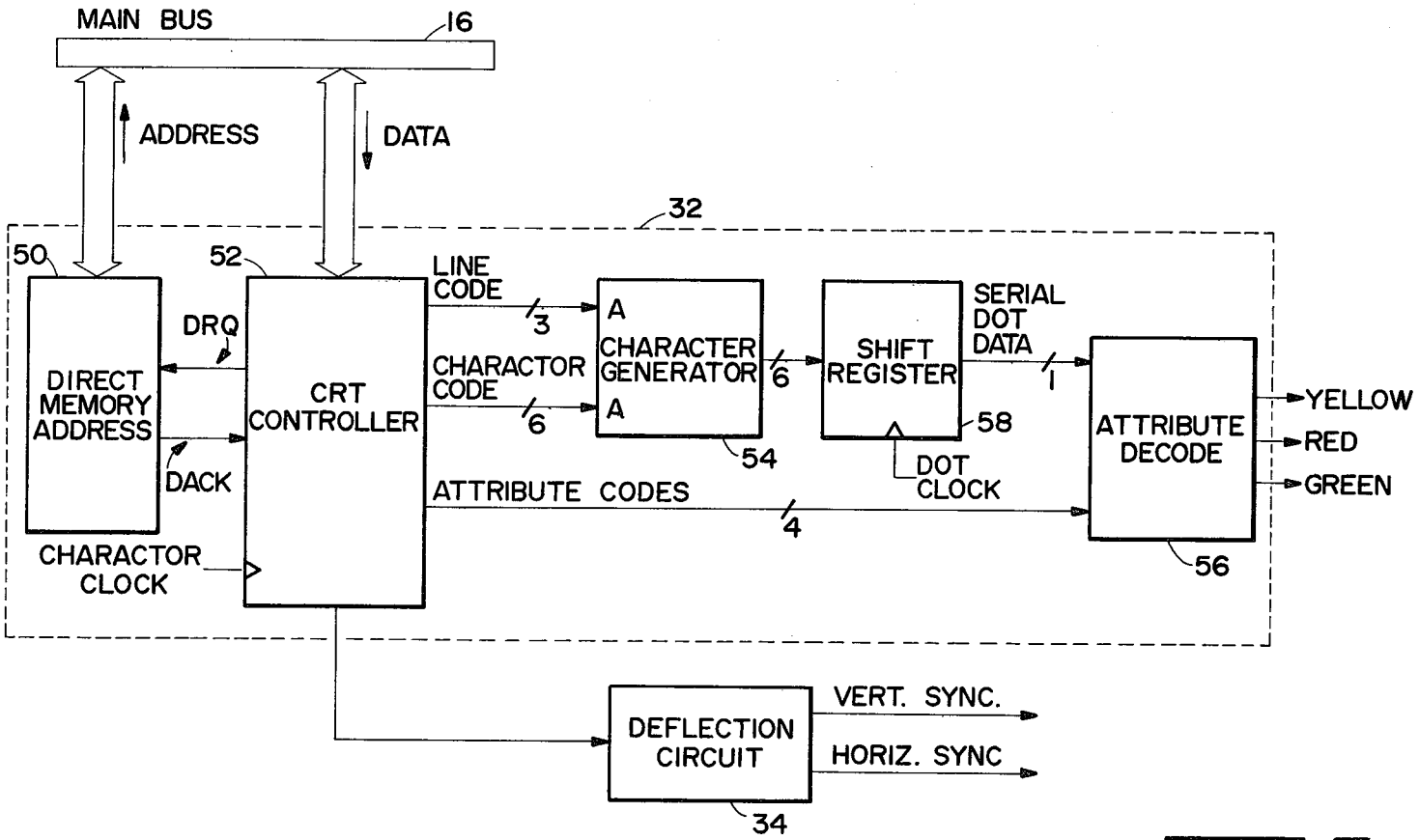

The control unit 14 includes a control circuit 32 which fetches information from the RAM 24 and causes it to be displayed on the CRT. The control circuit 32 comprises a direct memory address circuit 50 (Intel 8257), a CRT controller 52 (Intel 8275), a character generator 54 (82 LS 181), a shift register 58 (74 LS 166) and an attribute decoder 56 (2×74 LS 153) which are connected as shown in FIG. 7. These blocks cooperate in known fashion in response to instructions and data received over the main bus 16 to cause the display unit to provide the desired display.

The display unit 30 comprises, in addition to the CRT 28, three electron guns 42, 44 and 46 which are driven by respective Z-axis amplifiers 36, 38 and 40 to provide three electron beams which are caused to scan the face of the CRT by deflection coils 48 which are driven by a deflection circuit 34.

Figure 2:
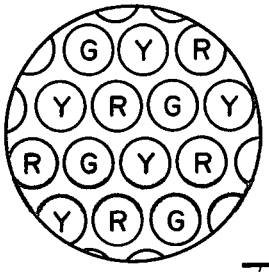
FIG. 2 shows, to a greatly enlarged scale, the arrangement of phosphors on the back of the faceplate of a CRT.

The CRT 28 is a shadow mask CRT and, in conventional manner, has an array of elementary phosphor areas deposited in the back of the faceplate in a black matrix. The phosphor areas are dots arranged in a triangular array, as shown in FIG. 2, but they may alternatively be parallel strips. However, unlike the conventional CRT, in which the phosphor areas are red, green and blue, in the CRT 28 the phosphor areas are red, green and yellow. (As used herein, the term "red phosphor", for example, means a phosphor which radiates red light when irradiated by a beam of electrons.) Yellow is chosen instead of blue for the third phosphor color because it is a higher acuity color than blue and it can be generated either by irradiating yellow phosphors only, against the black background of the matrix, or by irradiating both red and green phosphors (red and green combine to produce yellow): in a logic analyzer display apparatus, it is not necessary to be able to reproduce an image in natural color, and it is more important to have the capability of displaying information in a few colors which are clearly discernible from one another.

Figure 3:
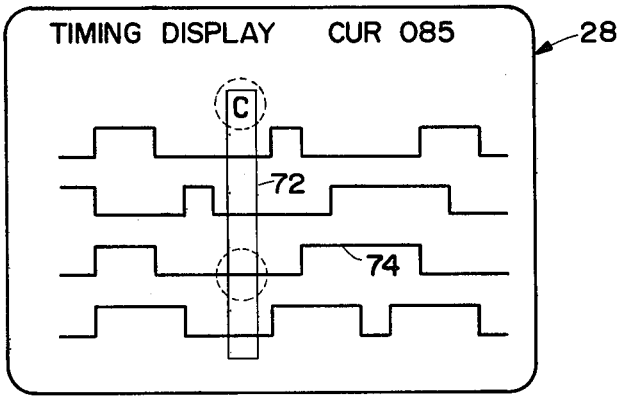
FIG. 3 illustrates a typical display provided by the logic analyzer display apparatus of FIG. 1.

The ROM 26 determines the video attributes of each character that is displayed. Thus, the ROM 26 causes characters of background information, such as column headings, to be displayed in green. Characters of foreground information, e.g. characters representing data acquired from the product under test, be it in the form of timing diagrams or alphanumeric characters, and word recognizers, are displayed in yellow. Attention-demanding information such as error messages and cursors, are displayed in red. Thus, in the display shown in FIG. 3 the words "TIME DISPLAY" and "CUR 085" (representing that the cursor bar 72 is at position 085) are shown in green, the timing waveforms, 74 for example, and the letter "C" (denoting cursor) within the cursor bar 72 are shown in yellow, and the cursor bar itself is shown in red. The general background of the display is black.

Figure 4:
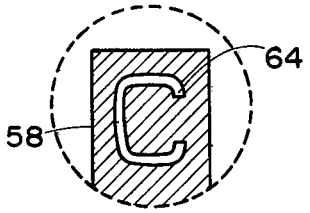
FIGS. 4 and 5 are enlarged views of respective regions of FIG. 3.
Figure 5:
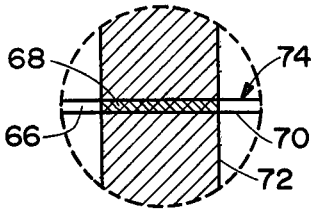

The cursor bar 72 is established by employing the electron gun 42 to irradiate all the red phosphor dots within the rectangular outline of the cursor bar. The yellow letter "C", designated 64 and shown to an enlarged scale in FIG. 4, is established by employing the electron gun 44 to irradiate the green phosphor dots within the outline of the letter "C", and the green light radiated by the green phosphor dots combines with the red light radiated by the red phosphor dots to provide a yellow "C". Since the control of the gun 44 is independent of the gun 42, misconvergence of the beams from the guns 42 and 44 does not present a problem. Similarly, where a yellow timing waveform crosses the red cursor bar, as shown at 68 in FIG. 5, the yellow is established by irradiating the green phosphor dots within the area 68. The waveform portions 66 and 70, outside the bar 72, are established simply by irradiating the appropriate yellow phosphor dots, and the misconvergence is small relative to the step height of the waveform and is therefore tolerable. Thus, the CRT 28 is able to display three high acuity colors without its being necessary to energize more than two of the electron guns at any one time. Accordingly, misconvergence does not represent a problem and therefore a self converged CRT can be employed. By using yellow phosphor dots, a high acuity color can be used to display foreground information. Since it is only necessary to use more than one electron gun when yellow is displayed against a red field, and red is used as an attention-demanding color and is therefore used only in a relatively small number of characters, more than one electron gun is only used for displaying a small number of characters relative to the total number of characters displayed.

INDUSTRIAL APPLICABILITY

The invention is applicable to the production of a logic analyzer display apparatus capable of providing a three-color display against a black or neutral background without its being necessary to employ convergence circuitry.

The invention is not restricted to the particular embodiments which have been described, since variations may be made therein without departing from the scope of the invention as defined in the appended claims.

We claim:

1. A color shadow mask cathode ray tube having a faceplate upon the back of which are deposited arrays of first, second and third phosphors which radiate first, second and third colors respectively when irradiated by electrons, and first, second and third electron guns for providing beams of electrons for irradiating the first, second and third phosphors respectively, the first, second and third colors being such that said third color is produced when said first and second colors are combined, whereby said third color may be produced either by irradiating the third phosphor or by irradiating both the first phosphor and the second phosphor.

2. A cathode ray tube in accordance with claim 1, wherein the first, second and third colors are red, green and yellow respectively.

3. A color display apparatus, comprising a cathode ray tube in accordance with claim 1 or 2, and control means for controlling the first, second and third electron guns to cause the third color to be produced by irradiating the first and second phosphors when the third color is to be displayed in an area adjacent to an area in which the first color is displayed, and to cause the third color to be produced by irradiating the third phosphor when the third color is to be displayed in an area which is separate from areas in which the first color is displayed.

4. A method of providing a color display, comprising employing a shadow mask color CRT having a face plate upon the back of which are deposited arrays of first, second and third phosphors which radiate first, second and third colors respectively when irradiated by electrons, providing first, second and third electron beams for irradiating the first, second and third phosphors respectively, the first, second and third colors being such that said third color is produced when said first and second colors are combined, and the first, second and third electron beams are controlled to cause the third color to be produced by irradiating the first and second phosphors when the third color is to be displayed in an area adjacent to an area in which the first color is displayed, and to cause the third color to be produced by irradiating the third phosphor when the third color is to be displayed in an area which is separate from areas in which the first color is displayed.

5. A method in accordance with claim 4, wherein the first, second and third colors are red, green and yellow respectively.

* * * * *